US012140392B1

(12) United States Patent
Kumar et al.

(10) Patent No.: US 12,140,392 B1
(45) Date of Patent: Nov. 12, 2024

(54) MUZZLE-END ADAPTER FOR BORESIGHTING OF LARGE CALIBER GUNS

(71) Applicant: Tonbo Imaging Pte. Ltd., Singapore (SG)

(72) Inventors: Ankit Kumar, Bangalore (IN); Kondangi Lakshmikumar Arvind, Singapore (SG); Nelaji Mohanrao Sudarshan, Bangalore (IN)

(73) Assignee: Tonbo Imaging Pte. Ltd., Singapore (SG)

( * ) Notice: Subject to any disclaimer, the term of this patent is extended or adjusted under 35 U.S.C. 154(b) by 0 days.

(21) Appl. No.: 18/051,368

(22) Filed: Oct. 31, 2022

(51) Int. Cl.
*F41A 21/32* (2006.01)
*F41G 1/54* (2006.01)

(52) U.S. Cl.
CPC ..... *F41A 21/325* (2013.01); *F41G 1/545* (2013.01)

(58) Field of Classification Search
CPC ..... F41A 21/325; F41G 1/545
USPC ..... 42/134
See application file for complete search history.

(56) References Cited

U.S. PATENT DOCUMENTS 6,371,004 B1 * 4/2002 Peterson ..... F41G 1/545 356/153

* cited by examiner

*Primary Examiner* — Samir Abdosh
(74) *Attorney, Agent, or Firm* — Kolisch Hartwell, P.C.

(57) ABSTRACT

The present disclosure provides a muzzle-end adapter for bore sighting of large caliber guns. The muzzle-end adapter includes a main operating shaft extending along a first longitudinal axis. The muzzle-end adapter includes a disk. Further, the muzzle-end adapter includes a main body. The main body encapsulates the main operating shaft. Furthermore, the muzzle-end adapter includes a first-section and a second-section. The second-section includes a plurality of sets of centering fingers. The second-section encapsulates the disk. Moreover, the muzzle-end adapter includes a plurality of conical disks. The plurality of conical disks includes a first conical disk and a second conical disk. The first conical disk is positioned at a second end of the second-section. The second conical disk is positioned at a first end of the second-section. Also, rectilinear motion of the second-section over the plurality of conical disks radially expands centering fingers of the plurality of sets of centering fingers.

17 Claims, 7 Drawing Sheets

500

600

MUZZLE-END ADAPTER FOR BORESIGHTING OF LARGE CALIBER GUNS

TECHNICAL FIELD

This invention relates to a bore sighting apparatus and, in particular relates to an adapter that inserts inside bore of a weapon for performing bore sighting of the weapon.

BACKGROUND

Bore sighting refers to a method of adjustment to an optical firearm sight to align firearm barrel and sights. The axis of barrel of a firearm must be either parallel or must cross the axis of optical sighting system of the firearm. Therefore, a pre-determined relationship must be established between axis of the barrel and the axis of the optical sighting system of the firearm. However, the axis of the optical sighting system of firearms usually gets displaced from the axis of the barrel of the firearm. This displacement occurs due to a number of reasons such as changes resulting from material strains, thermal expansion of firearms during firing, varying environmental temperature and so on. Therefore, recalibration must be done from time to time. The relationship between the axis of the barrel of the firearm and the axis of the optical sighting system of the firearm is established. Accordingly, a sight is made to a calibration target at a given distance. Further, the line of sight is established along the axis of the barrel of the firearm for accurate and effective bore sighting. Furthermore, the axis of the optical sighting system is calibrated in accordance with the axis of the barrel of the firearm.

SUMMARY

In an aspect, the present disclosure includes a muzzle-end adapter for bore sighting of large caliber guns. The muzzle-end adapter includes a main operating shaft extending along a first longitudinal axis. The muzzle-end adapter includes a disk. The muzzle-end adapter includes a main body lying substantially along the first longitudinal axis. The disk is mechanically coupled with the main operating shaft. The rotation of the main operating shaft provides rectilinear motion to the disk. The main body encapsulates the main operating shaft. The main body includes a first-section. The main body includes a second-section. The main body includes a plurality of conical disks. The second-section includes a plurality of sets of centering fingers. The second-section encapsulates the disk. The plurality of conical disks includes a first conical disk and a second conical disk. The first conical disk is positioned at the second end of the second-section. The second conical disk is positioned at the first end of the second-section. The rectilinear motion of the second-section over the plurality of conical disks radially expands centering fingers of the plurality of sets of centering fingers.

In an embodiment of the present disclosure, the main operating shaft includes a first shaft end and a second shaft end. The first-section includes a first end face and a second end face. The first end face of the first-section is co-planar to the first shaft end of the main operating shaft.

In an embodiment of the present disclosure, the periphery of the disk is rigidly affixed with the second-section such that the second-section reciprocates with the disk.

In an embodiment of the present disclosure, the plurality of conical disks is coaxial with the main operating shaft.

In an embodiment of the present disclosure, the second-section is characterized by a cylindrical cross-section. The second-section includes a first end and a second end. The cylindrical cross-section of the second-section enables insertion of the second-section into bore of a large caliber gun. The second-section is inserted inside bore of the large caliber gun. The centering fingers of the plurality of sets of centering fingers expand uniformly to align symmetrically with the bore of a large caliber gun. The symmetrical alignment of the muzzle-end adapter inside bore of the large caliper gun enables bore sighting of the large caliber guns.

In an embodiment of the present disclosure, the first conical disk is rigidly affixed with the first-section of the main body. The second conical disk is affixed with the first conical disk with the facilitation of a plurality of rigid bars.

In an embodiment of the present disclosure, the main operating shaft includes a tapered intrusion designed to receive an imaging device having a corresponding conical attachment. The tapered intrusion includes a plurality of grooves. The plurality of grooves enables a spring-loaded self-locking mechanism for the imaging device.

In an embodiment of the present disclosure, the plurality of sets of centering fingers includes a first set of centering fingers and a second set of centering fingers. The first set of centering fingers includes a plurality of centering fingers. The second set of centering fingers includes a plurality of centering fingers.

In an embodiment of the present disclosure, the main operating shaft includes a first threading. The first conical disk includes a second threading. The main operating shaft is fastened with the facilitation of threads with the first conical disk.

In another aspect, the present disclosure includes a muzzle-end adapter for bore sighting of large caliber guns. The muzzle-end adapter includes a main operating shaft extending along a first longitudinal axis. The muzzle-end adapter includes a disk. The muzzle-end adapter includes a main body lying substantially along the first longitudinal axis. The main operating shaft includes a first shaft end and a second shaft end. The disk is mechanically coupled with the main operating shaft. The rotation of the main operating shaft provides rectilinear motion to the disk. The main body encapsulates the main operating shaft. The main body includes a first-section. The main body includes a second-section. The main body includes a plurality of conical disks. The first-section includes a first end face and a second end face. The first end face of the first-section is co-planar to the first shaft end of the main operating shaft. The second-section is characterized by a cylindrical cross-section. The second-section is having a first end and a second end. The second-section includes a plurality of sets of centering fingers. The second-section encapsulates the disk. The periphery of the disk is rigidly affixed with the second-section such that the second-section reciprocate with the disk. The plurality of conical disks are coaxial with the main operating shaft. The plurality of conical disks includes a first conical disk and a second conical disk. The first conical disk is positioned at the second end of the second-section. The second conical disk is positioned at the first end of the second-section. The rectilinear motion of the second-section over the plurality of conical disks radially expands centering fingers of the plurality of sets of centering fingers.

In an embodiment of the present disclosure, the muzzle-end adapter further includes a first-hand lever and a second-hand lever. The first-hand level is rigidly affixed with the first shaft end of the main operating shaft. The second-hand level is rigidly affixed with the first end face of the first-section.

In an embodiment of the present disclosure, the outer surface of the disk is rigidly affixed with a portion of the inner surface of the second-section.

In an embodiment of the present disclosure, the first conical disk is rigidly affixed with the first-section of the main body. The second conical disk is affixed with the first conical disk with the facilitation of a plurality of rigid bars.

In an embodiment of the present disclosure, the main operating shaft is having a tapered intrusion on the first shaft end. The tapered intrusion is designed to receive an imaging device having a corresponding conical attachment. The tapered intrusion includes a plurality of grooves. The plurality of grooves enables a spring-loaded self-locking mechanism for the imaging device.

In an embodiment of the present disclosure, cylindrical cross section of the second-section enable insertion of the second-section into bore of a large caliber gun. The second-section is inserted inside bore of the large caliber gun. The centering fingers of the plurality of sets of centering fingers expand uniformly to align symmetrically with the bore of the large caliber gun. The symmetrical alignment of the muzzle-end adapter inside bore of the large caliper gun enable bore sighting of the large caliber guns.

In an embodiment of the present disclosure, the plurality of sets of centering fingers includes a first set of centering fingers and a second set of centering fingers. The first set of centering fingers includes a plurality of centering fingers. The second set of centering fingers includes a plurality of centering fingers. The plurality of centering fingers of the first set of centering fingers are uniformly distributed over the second-section adjacent to the first end of the second-section. The plurality of centering fingers of the second set of centering fingers are uniformly distributed over the second-section adjacent to the second end of the second-section.

In an embodiment of the present disclosure, the main operating shaft is having a first threading. The first conical disk is having a second threading. The main operating shaft is fastened with the facilitation of threads with the first conical disk.

In yet another aspect, the present disclosure includes a muzzle-end adapter for bore sighting of large caliber guns. The muzzle-end adapter includes a main operating shaft extending along a first longitudinal axis. The muzzle-end adapter includes a disk. The muzzle-end adapter includes a main body lying substantially along the first longitudinal axis. The main operating shaft includes a first threading. The main operating shaft includes a tapered intrusion on the first shaft end. The tapered intrusion is designed to receive an imaging device having a corresponding conical attachment. The main operating shaft includes a first shaft end and a second shaft end. The disk is mechanically coupled with the main operating shaft. The rotation of the main operating shaft provides rectilinear motion to the disk. The main body encapsulates the main operating shaft. The main body includes a first-section. The main body includes a second section. The main body includes a plurality of conical disks. The first-section includes a first end face and a second end face. The first end face of the first-section is co-planar to the first shaft end of the main operating shaft. The second-section is characterized by a cylindrical cross-section. The second-section includes a first end and a second end. The second-section includes a plurality of sets of centering fingers. The second-section encapsulates the disk. The periphery of the disk is rigidly affixed with the second-section such that the second-section reciprocate with the disk. The plurality of conical disks are coaxial with the main operating shaft. The plurality of conical disks includes a first conical disk and a second conical disk. The first conical disk is positioned at the second end of the second-section. The first conical disk includes a second threading. The main operating shaft is fastened with facilitation of threads with the first conical disk. The second conical disk is positioned at the first end of the second-section. The rectilinear motion of the second-section over the plurality of conical disks radially expands centering fingers of the plurality of sets of centering fingers. The cylindrical cross section of the second-section enable insertion of the second-section into bore of a large caliber gun. The second-section is inserted inside bore of the large caliber gun. The centering fingers of the plurality of sets of centering fingers expand uniformly to align symmetrically with the bore of the large caliber gun. The symmetrical alignment of the muzzle-end adapter inside bore of the large caliper gun enable bore sighting of the large caliber guns.

In an embodiment of the present disclosure, the muzzle-end adapter further includes a first-hand lever and a second-hand lever. The first-hand level is rigidly affixed with the first shaft end of the main operating shaft. The second-hand level is rigidly affixed with the first end face of the first-section. The tapered intrusion includes a plurality of grooves. The plurality of grooves enables a spring-loaded self-locking mechanism for the imaging device.

In an embodiment of the present disclosure, centering fingers of the plurality of sets of centering fingers expand uniformly to align symmetrically with the bore of the large caliber gun. The symmetrical alignment of the muzzle-end adapter inside bore of the large caliper gun enable bore sighting of the large caliber guns. The plurality of sets of centering fingers includes a first set of centering fingers and a second set of centering fingers. The first set of centering fingers includes a plurality of centering fingers. The second set of centering fingers includes a plurality of centering fingers. The plurality of centering fingers of the first set of centering fingers are uniformly distributed over the second-section adjacent to the first end of the second-section. The plurality of centering fingers of the second set of centering fingers are uniformly distributed over the second-section adjacent to the second end of the second-section.

BRIEF DESCRIPTION OF THE FIGURES

Figure 1A:
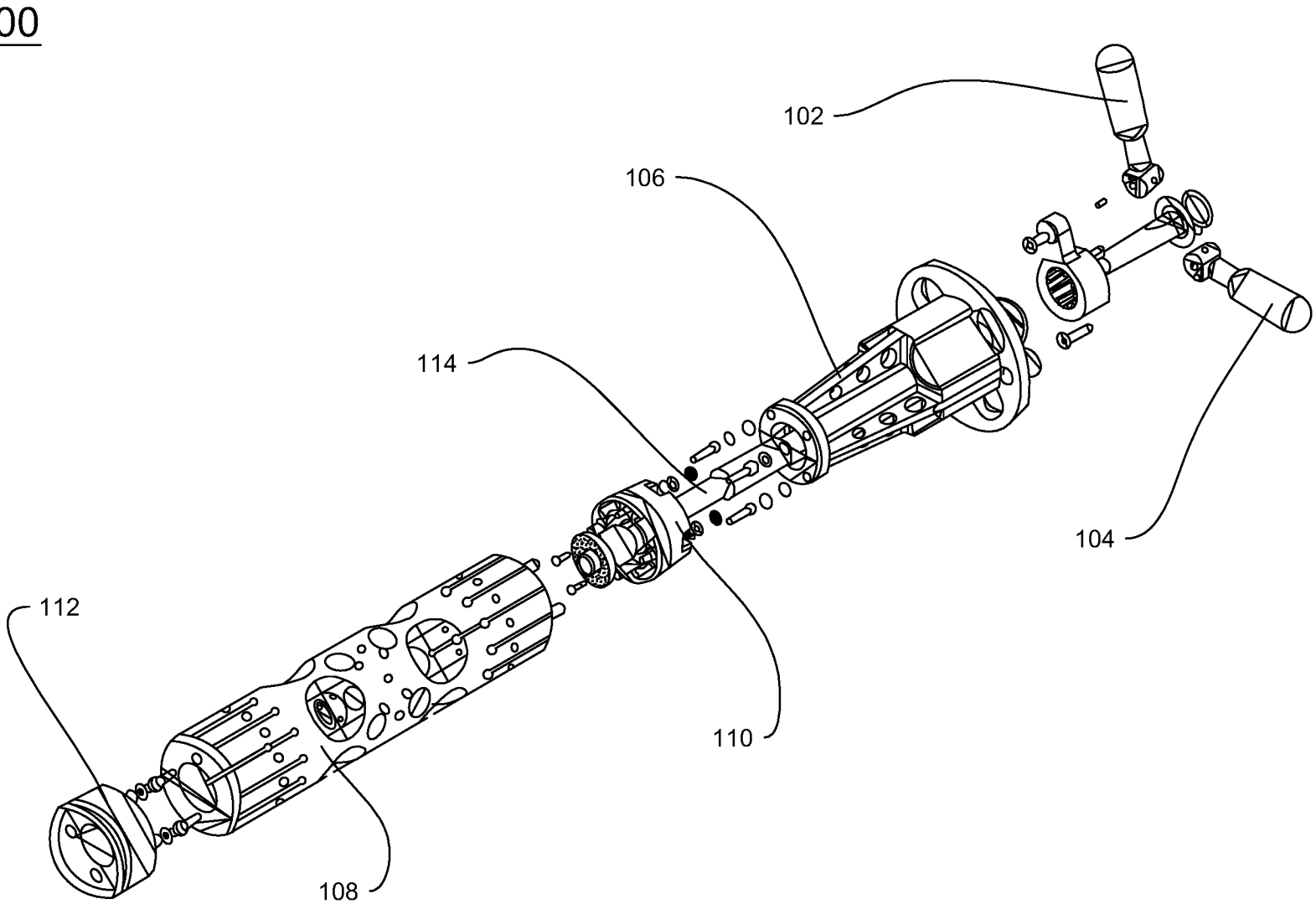
Figure 1B:
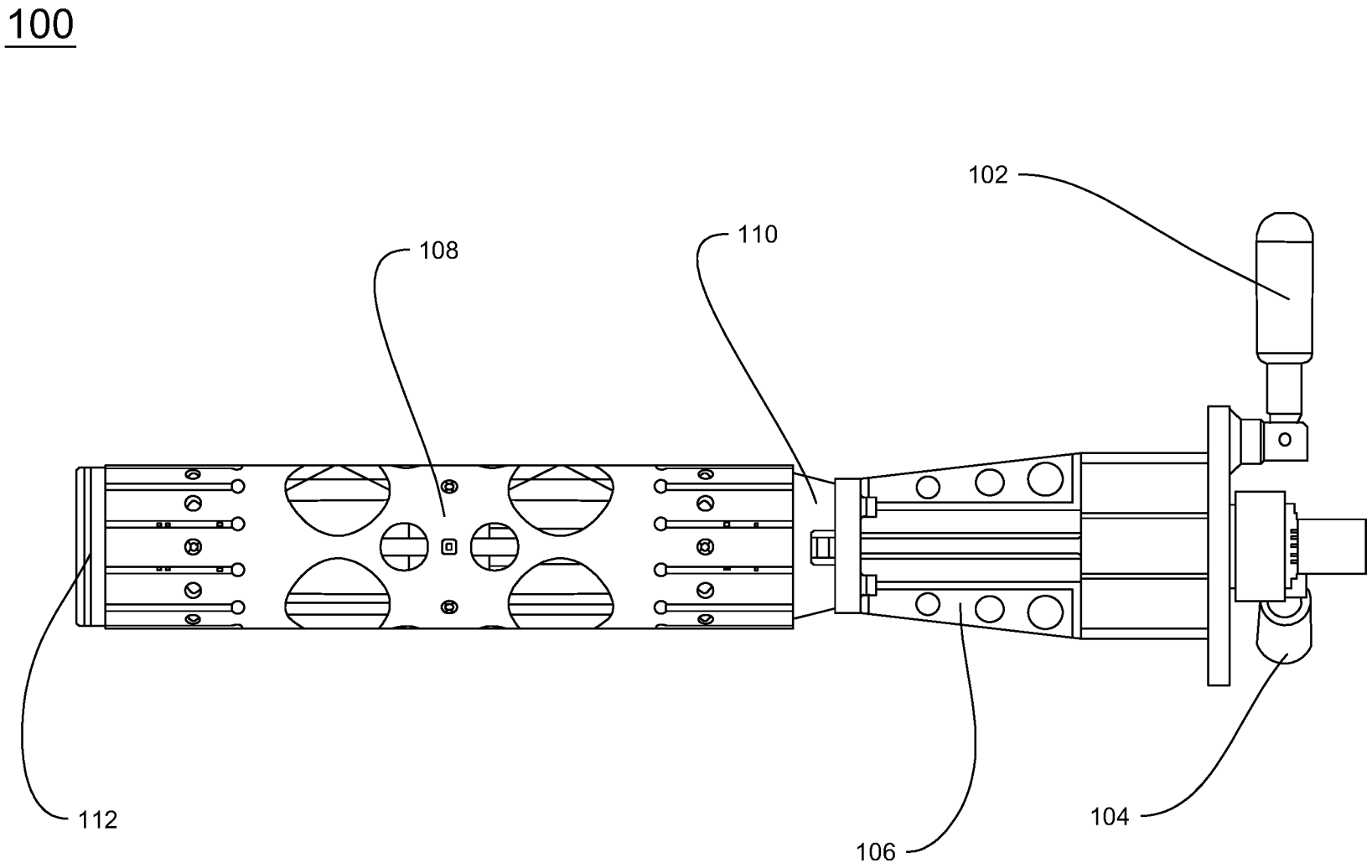
Figure 2:
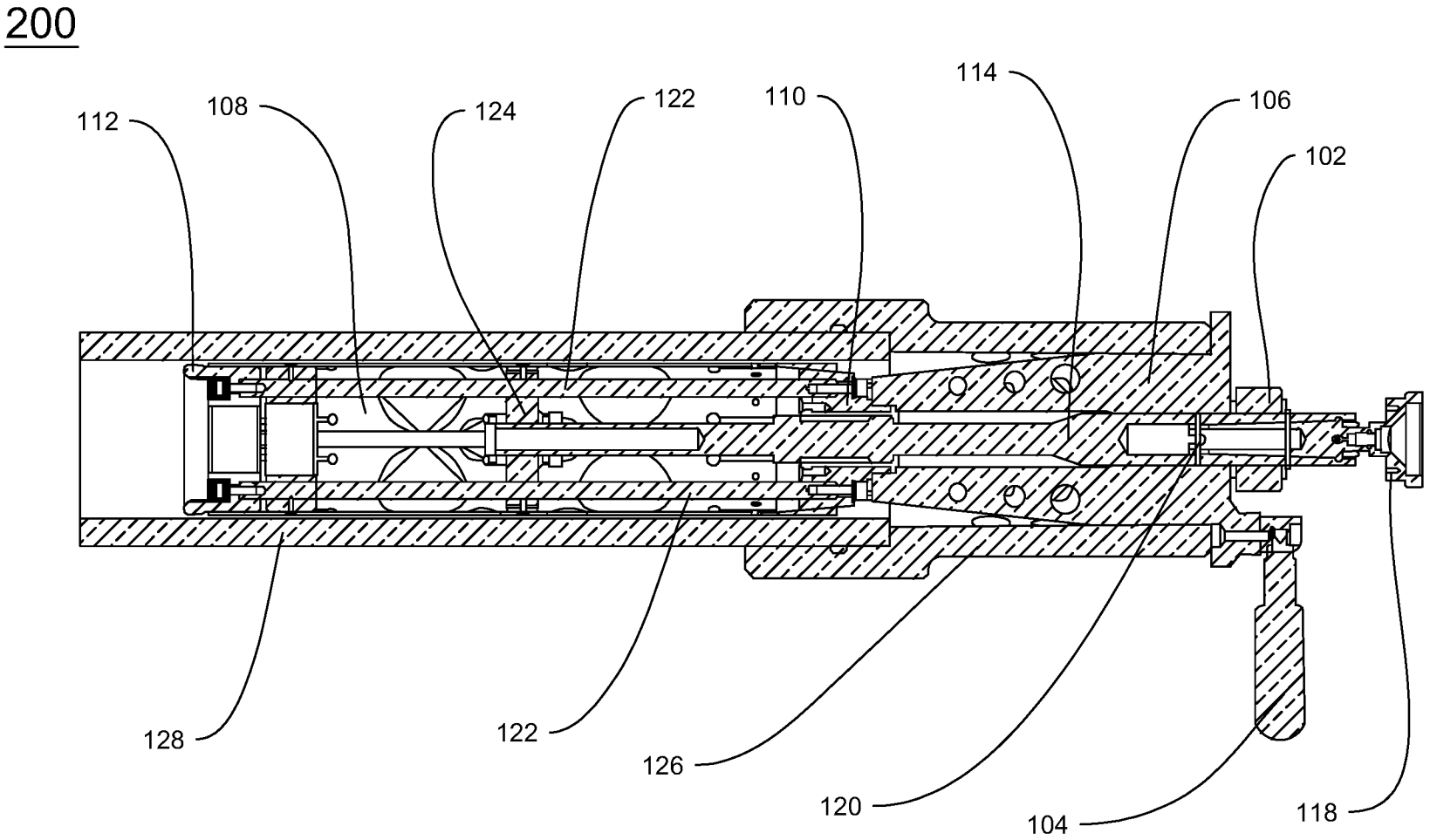
Figure 3:
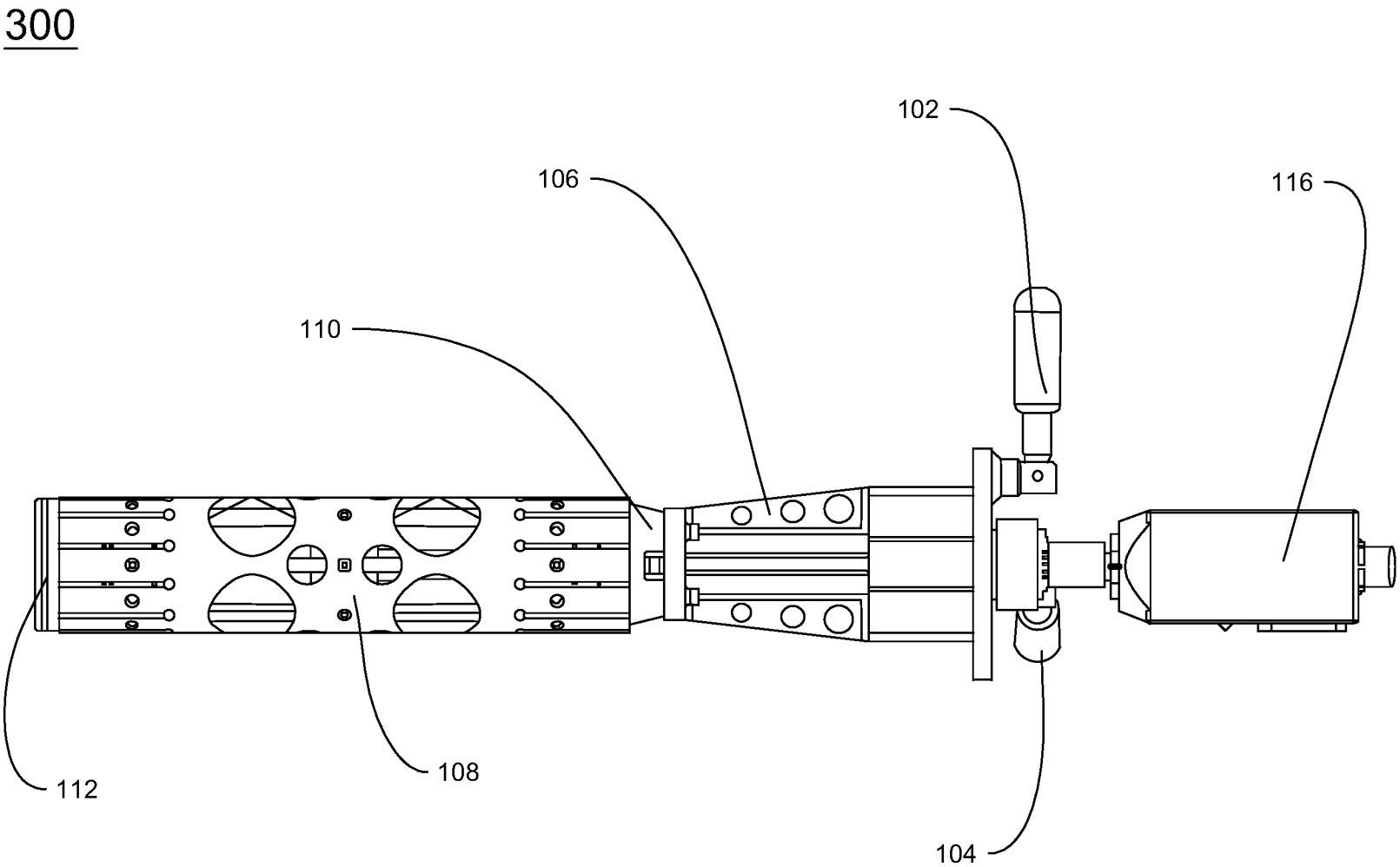
Figure 4:
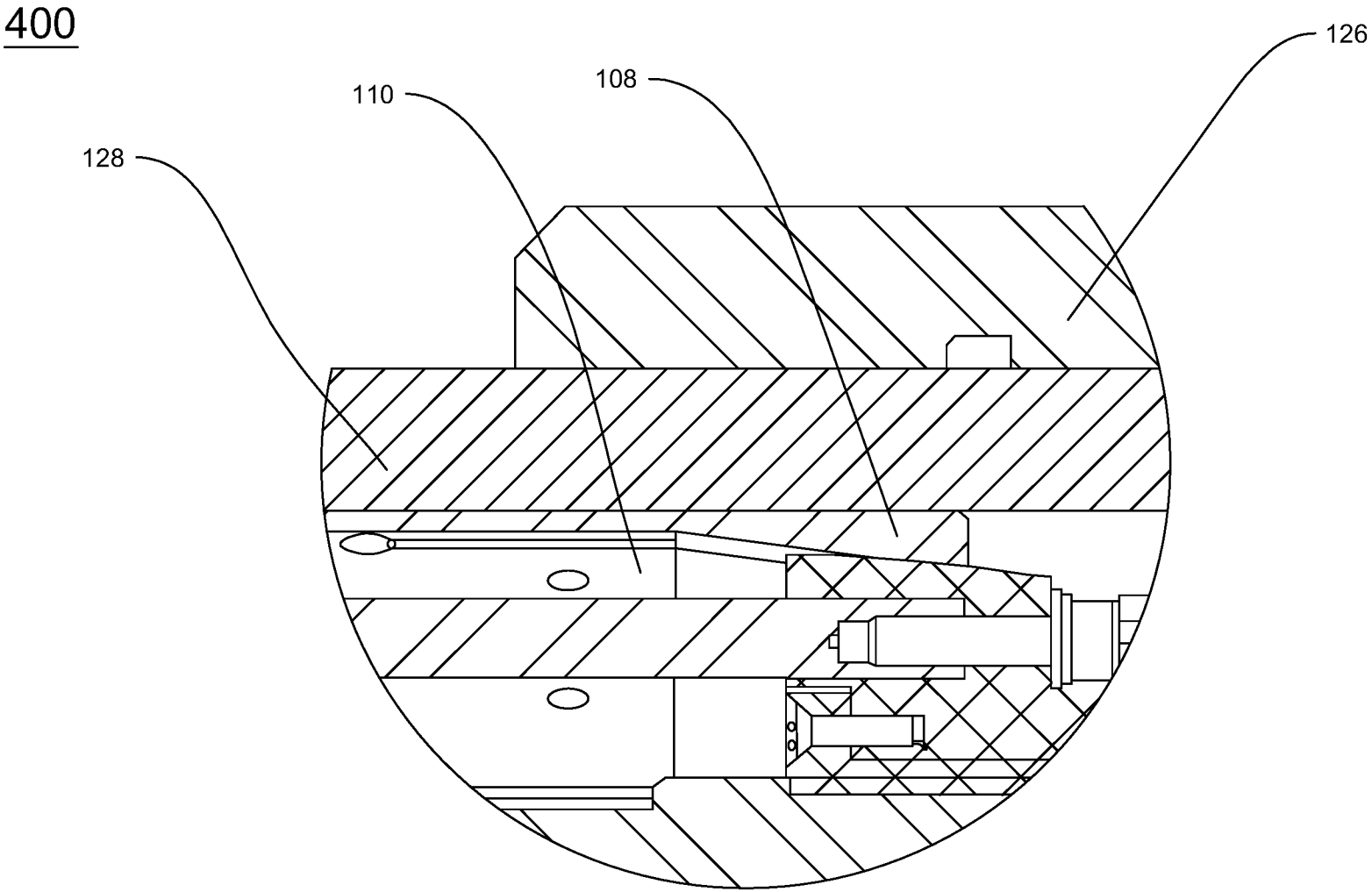
Figure 5:
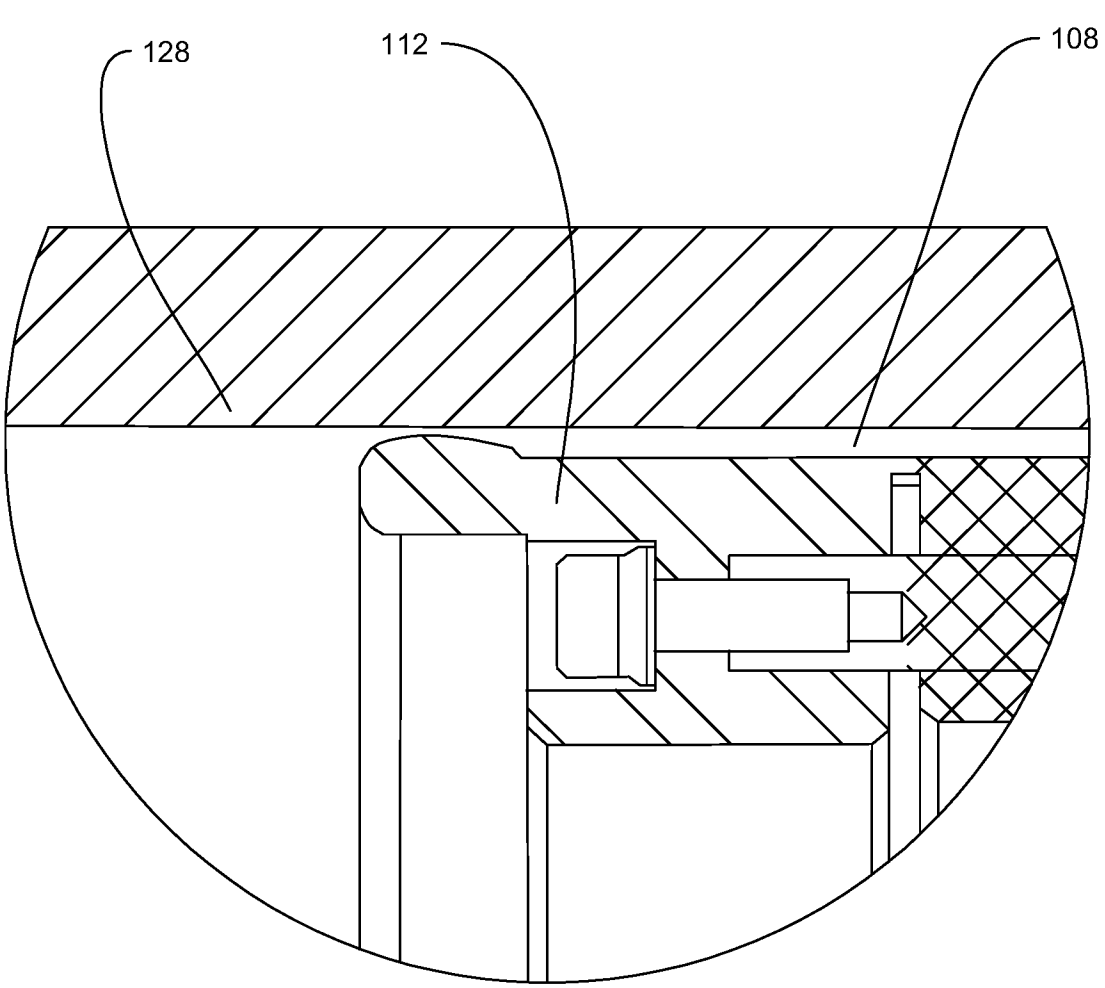
Figure 6:
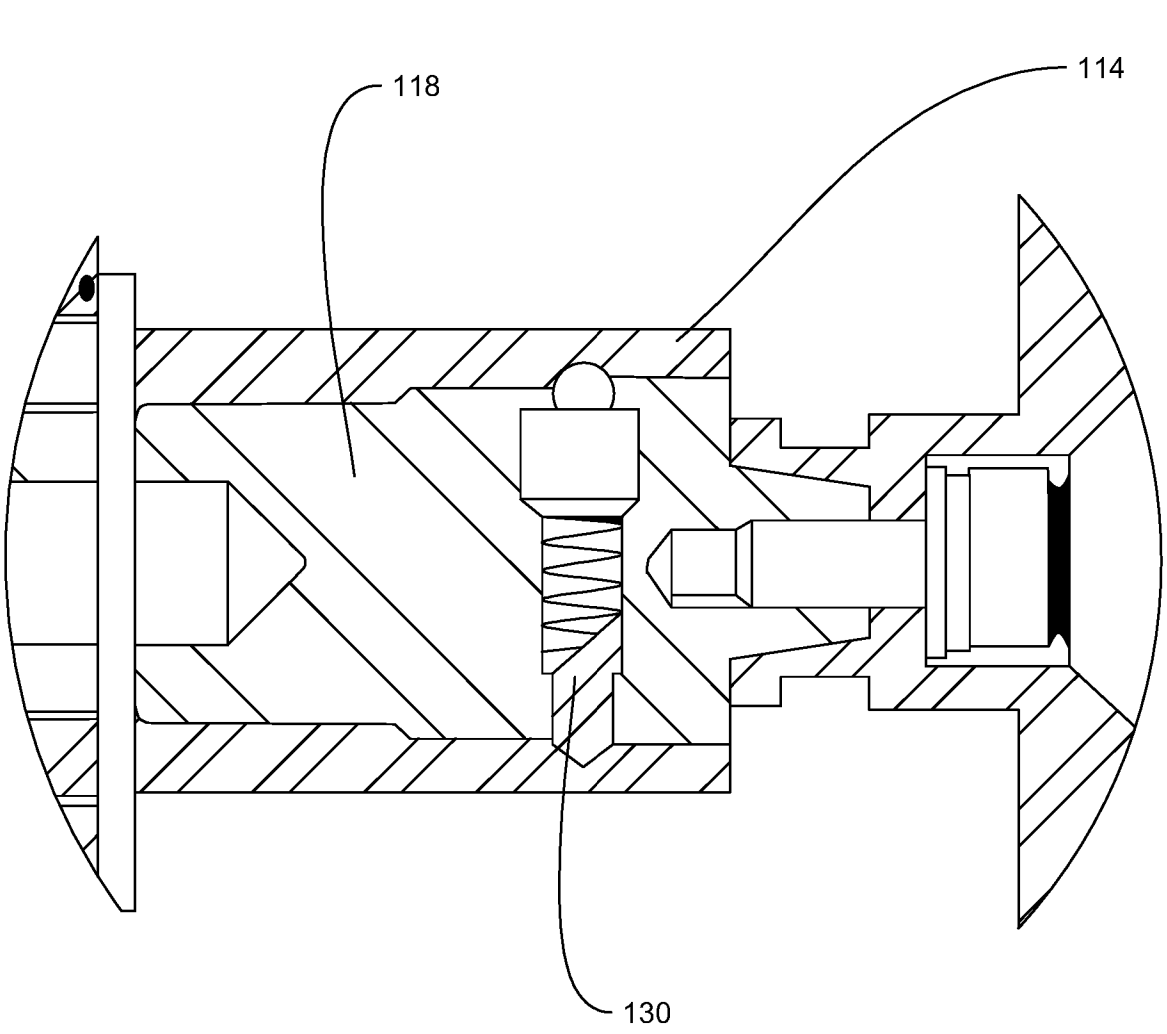

Having thus described the disclosure in general terms, reference will now be made to the accompanying figures, wherein;

FIG. 1A illustrates an exploded perspective view of a muzzle-end adapter for bore sighting of a large caliber gun, in accordance with an embodiment of the present disclosure;

FIG. 1B illustrates a perspective view of the muzzle-end adapter, in accordance with various embodiments of the present disclosure;

FIG. 2 illustrates a section view of the muzzle-end adapter inside a bore of the large caliber gun, in accordance with various embodiments of the present disclosure;

FIG. 3 illustrates a perspective view of the muzzle-end adapter along with an imaging device for performing the bore sighting of the large caliber gun, in accordance with various embodiments of the present disclosure;

FIG. 4 illustrates a section view of a first conical disk of the muzzle-end adapter of FIG. 1A, in accordance with an embodiment of the present disclosure;

FIG. 5 illustrates a section view of a second conical disk of the muzzle-end adapter of FIG. 1A, in accordance with an embodiment of the present disclosure; and FIG. 6 illustrates a section view of a spring-loaded locking mechanism, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but no other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

It should be noted that the terms "first", "second", and the like, herein do not denote any order, ranking, quantity, or importance, but rather are used to distinguish one element from another. Further, the terms "a" and "an" herein do not denote a limitation of quantity, but rather denote the presence of at least one of the referenced item.

FIG. 1A illustrates an exploded perspective view of a muzzle-end adapter 100 for bore sighting of a large caliber gun, in accordance with an embodiment of the present disclosure. FIG. 1B illustrates a perspective view of the muzzle-end adapter 100, in accordance with various embodiments of the present disclosure. FIG. 2 illustrates a section view of the muzzle-end adapter 100 inside a bore 128 of the large caliber gun, in accordance with various embodiments of the present disclosure. FIG. 3 illustrates a perspective view of the muzzle-end adapter 100 along with an imaging device 116 for performing the bore sighting of the large caliber gun, in accordance with various embodiments of the present disclosure. FIG. 4 illustrates a section view of a first conical disk 110 of the muzzle-end adapter 100 of FIG. 1A, in accordance with an embodiment of the present disclosure. FIG. 5 illustrates a section view of a second conical disk 112 of the muzzle-end adapter 100 of FIG. 1A, in accordance with an embodiment of the present disclosure. FIG. 6 illustrates a section view of a spring-loaded locking mechanism, in accordance with an embodiment of the present disclosure.

The muzzle-end adapter 100 includes a first-hand lever 102, a second-hand lever 104, a first-section 106, a second-section 108, the first conical disk 110, the second conical disk 112, a main operating shaft 114, and the imaging device 116. In addition, the muzzle-end adapter 100 includes a plurality of grooves 120, a plurality of rigid bars 122, a disk 124, and a spring-loaded pin 130. Moreover, the large caliber gun includes a muzzle brake 126, conical attachment 118 and the bore 128 of the large caliber gun.

In an embodiment of the present disclosure, the muzzle end adapter 100 is of suitable length such that the muzzle end adapter 100 passes through length of the bore 128 of the large caliber gun. In an embodiment of the present disclosure, the muzzle end adapter 100 is made up of a suitable material. In an example, the suitable material may include aluminum, alloy, metal, rubber, plastic and the like.

The muzzle end adapter 100 includes a plurality of hand levers. The plurality of hand levers includes the first hand lever 102 and the second hand lever 104. The plurality of hand levers is positioned at a first end face of the first-section 106 of the muzzle end adapter 100. In general, hand lever is used to exert a large force over a small distance at one end by exerting only a small force over a greater distance at the other. In an example, hand lever comes in a plurality of configurations. The plurality of configurations includes but may not be limited to hydraulic, pneumatic, and motor-powered. In general, hand lever is used in a variety of vehicles and other large machinery. In an embodiment of the present disclosure, the plurality of hand levers is made up of suitable material. In an example, the suitable material includes iron, steel, wood, plastic and the like.

The first hand lever 102 is rigidly connected with a first shaft end of the main operating shaft 114. The second hand lever 104 is rigidly connected with the first end face of the first-section 106. The plurality of hand levers is held by a user for inserting the muzzle end adapter 100 inside the bore 128 of the large caliber gun. The user utilizes the second-hand lever 104 to hold the muzzle end adapter 100 firmly. The first hand lever 102 is rotated in a first direction by the user. In an embodiment of the present disclosure, the first direction represents right direction. In another embodiment of the present disclosure, the first direction represents any other direction. In an embodiment of the present disclosure, the user applies torque in the first direction using the first-hand lever 102.

In an embodiment of the present disclosure, the user is any entity that has authority to use the muzzle-end adapter 100. In addition, the user is any person who performs the bore sighting of the large caliber gun. In another embodiment of the present disclosure, the user is any person who handles operation of the muzzle end adapter 100. In yet another embodiment of the present disclosure, the user is any person who performs maintenance of the muzzle end adapter 100. In yet another embodiment of the present disclosure, the user is any person that has knowledge to operate the muzzle end adapter 100 to perform the bore sighting of the large caliber gun. In general, it is necessary to adjust optical sight of the large caliber gun. The optical sight is adjusted at a pre-established angle with bore of barrel of the large caliber gun. The process is termed as bore sighting. In general, the bore sighting ensures accurate zeroing of the large caliber gun, thereby removing inaccuracies prior to fire for effect. Further, the bore sighting improves 'first round hit probability' (hereinafter, FRHP) of the large caliber gun.

The muzzle-end adapter 100 includes a main body. The main body includes a plurality of sections. The plurality of sections includes the first-section 106 and the second-section 108. The first-section 106 is conical in shape. The first-section 106 includes the first end face and a second end face. The first end face of the first-section 106 is situated near the plurality of hand levers. The second end face of the first-section 106 is situated opposite to the first end face of the first-section 106. Further, the second end face of the first-section 106 is connected to the second-section 108. The second-section 108 is characterized by a cylindrical cross-section. The cylindrical cross section of the second-section 108 enables insertion of the second-section 108 into the bore 128 of the large caliber gun. The second-section 108 is inserted inside the bore 128 of the large caliber gun. In addition, the second-section 108 includes a first end and a second end. The first end of the second-section 108 is the end that inserts inside the bore 128 of the large caliber gun. The second end of the second-section 108 is situated close to the second end face of the first-section 106. Also, the second-section 108 extends inwards of the bore 128 of the large caliber gun.

The second-section 108 encapsulates the disk 124. The disk is characterized by an outer surface. The outer surface of the disk 124 is rigidly affixed with a portion of an inner surface of the second-section 108.

The second-section 108 of the muzzle-end adapter 100 includes a plurality of centering devices. The plurality of centering devices includes a plurality of sets of centering fingers. The plurality of sets of centering fingers is formed onto cylindrical cross-sectional area of the second section 108. The plurality of sets of centering fingers includes a first set of centering fingers and a second set of centering fingers. The first set of centering fingers includes a plurality of centering fingers. The second set of centering fingers includes a plurality of centering fingers. The first set of centering fingers are uniformly distributed over the second-section 108 adjacent to the first end of the second-section 108. The second set of centering fingers are uniformly distributed over the second-section 108 adjacent to the second end of the second-section 108. The first set of centering fingers are formed onto the first end of the second-section 108. The second set of centering fingers are formed onto the second end of the second-section 108. The plurality of sets of centering fingers has outer edges. Outer edges of the sets of centering fingers herein also referred as lips. The outer edges of the plurality of sets of centering fingers are essentially concentric to an axis of the main operating shaft 114. Also, the plurality of sets of centering fingers has same radii. Moreover, the plurality of sets of centering fingers has inner edges. The inner edges of the plurality of sets of centering fingers are defined on an incline. The incline mates with an outer periphery of a plurality of conical disks. The second-section 108 of the muzzle end adapter 100 inserts inside the bore 128 of the large caliber gun. In general, bore is interior of barrel of any gun or firearm. In an example, the large caliber gun may be mounted to a tank, on combat ships, fighter plane, and the like.

The muzzle end adapter 100 includes the main operating shaft 114. The main body encapsulates the main operating shaft 114. The main operating shaft 114 is mechanically coupled with the disk 124. Also, the disk 124 is mechanically coupled with the main operating shaft 114. The rotation of the main operating shaft 114 provides a rectilinear motion to the disk 124. Further, the main operating shaft 114 includes the first shaft end and a second shaft end. The first shaft end of the main operating shaft 114 is close to the first end face of the first-section 106. The second shaft end of the main operating shaft 114 is close to the first end of the second-section 108. The first end face of the first-section 106 is co-planar to the first shaft end of the main operating shaft 114. The main operating shaft 114 is connected rigidly with the first-hand lever 102. The main operating shaft 114 extends along a first longitudinal axis of the muzzle end adapter 100. In general, the first longitudinal axis is an imaginary axis passing through lengthwise direction of any figure or body. The main operating shaft 114 rotates in the first direction upon rotation of the first-hand lever 102 by the user. In an embodiment of the present disclosure, the main operating shaft 114 is threaded to a collar connected with the muzzle end adapter 100.

The muzzle-end adapter 100 includes the plurality of conical disks. The plurality of conical disks includes the first conical disk 110 and the second conical disk 112. The first conical disk 110 is rigidly affixed with the first-section 106. Also, the first conical disk 110 is positioned at the second end of the second-section 108. The first conical disk 110 is rigidly affixed with the first-section 106 of the main body. The second conical disk 112 is positioned at the first end of the second-section 108. The plurality of conical disks is coaxial with the main operating shaft 114. The second-section 108 includes the plurality of rigid bars 122. The plurality of rigid bars 122 provides distance between the first conical disk 110 and the second conical disk 112. The second conical disk 112 is affixed with the first conical disk 110 with facilitation of the plurality of rigid bars 122. The first conical disk 110 and the second conical disk 112 are rigidly attached with the plurality of rigid bars 122. The plurality of rigid bars 122 pass through the disk 124. The plurality of rigid bars 122 restricts rotational motion of the disk 124. In an embodiment of the present disclosure, the plurality of rigid bars 122 facilitates in providing rectilinear motion to the disk 124.

In an embodiment of the present disclosure, the periphery of the disk 124 is rigidly affixed with the second-section 108 such that the second-section 108 reciprocates with the disk 124. The reciprocating motion is due to the rigid connection between the disk 124 and the second-section 108. In an embodiment of the present disclosure, the second end of the second-section 108 includes a conical feature around internal diameter of the second-section 108. In an embodiment of the present disclosure, the first end of the second-section 108 is cylindrical around internal diameter of the second-section 108.

The muzzle end adapter 100 includes a first threading and a second threading. In an embodiment of the present disclosure, the first threading is an external threading. In an embodiment of the present disclosure, the second threading is an internal threading. In general, internal threading is a receptacle used to receive and hold male threads. The disk 124 includes the second threading on internal diameter of the disk 124. The first conical disk 110 includes the second threading on internal diameter of the first conical disk 110. Further, the main operating shaft 114 includes the first threading on external diameter of the main operating shaft 114. The disk 124 is affixed with the main operating shaft 114 using the first threading and the second threading. Also, the first conical disk 110 is inserted into the main operating shaft 114 using the first threading and the second threading. The main operating shaft 114 has the first threading. The first conical disk 110 has the second threading. The main operating shaft 114 is fastened with the facilitation of threads with the first conical disk 110.

Furthermore, the rectilinear motion of the second-section 108 onto inner corresponding surfaces of the plurality of conical disks expands the plurality of sets of centering fingers. The plurality of sets of centering fingers expands radially and touch the internal diameter of the bore 128 of the large caliber gun. The plurality of sets of centering fingers enables a rigid connection between the muzzle-end adapter 100 and the bore 128 of the large caliber gun in coaxial manner. The one or more centering fingers of the plurality of sets of centering fingers expand uniformly to align symmetrically with the bore 128 of the large caliber gun. The symmetrical alignment of the muzzle-end adapter 100 inside the bore 128 of the large caliper gun enables the bore sighting of the large caliber guns.

The one or more centering fingers of the plurality of sets of centering fingers expand uniformly to align symmetrically with the bore 128 of the large caliber gun. The symmetrical alignment of the muzzle-end adapter inside the bore 128 of the large caliper gun enables the bore sighting of the large caliber gun.

The muzzle-end adapter 100 includes the tapered intrusion. The tapered intrusion is formed in the first shaft end of the main operating shaft 114. The tapered intrusion and the plurality of grooves 120 helps in holding the imaging device 116 in one or more positions. In an embodiment of the present disclosure, the imaging device 116 is a bore sighting telescope camera. The imaging device 116 includes a conical attachment 118. The conical attachment 118 includes the plurality of spring-loaded pin 130. The conical attachment 118 of the imaging device 116 is inserted into the tapered intrusion formed in the main operating shaft 114. The imaging device 116 is co-axial with the main operating shaft 116 through the first longitudinal axis of the muzzle end adapter 100. The plurality of spring-loaded pin 130 enables mechanism for self-locking of the imaging device 116. The self-locking of the imaging device 116 is done against axial displacement under all inclination angles of the large caliber gun. In an example, the one or more positions are positions that enables attachment of the imaging device 116 into two positions rotated by a point of right angles. In an embodiment of the present disclosure, the imaging device 116 has an appropriate Field of View (hereinafter, FOV). In general, FOV refers to open observable area up to which a person can see through his or her eyes with an optical device. The optical device may be camera, video sensing device, night vision device, thermal vision device, and the like. In case of optical devices, FOV describes angle through which devices can pick up electromagnetic radiations. In an embodiment of the present disclosure, the user makes a sight through the imaging device 116 to perform the bore sighting of the large caliber gun.

In an embodiment of the present disclosure, the imaging device 116 is connected with a monitor. The monitor is operated by an operator. In an embodiment of the present disclosure, the user and the operator is a same person. In another embodiment of the present disclosure, the user and the operator are different persons. In an embodiment of the present disclosure, the monitor is used to perform the bore sighting of the large caliber gun. In another embodiment of the present disclosure, the monitor is used to identify errors such as concentricity errors, misalignment errors, and the like of the large caliber gun.

In an embodiment of the present disclosure, the center of the bore 128 of the large caliber gun is located and aligned with the first longitudinal axis of the imaging device 116 by the operator. Further, the bore 128 of the large caliber gun is moved to sight of a target positioned at a known distance. In an embodiment of the present disclosure, an optical sighting system of the large caliber gun is adjusted to be parallel to the first longitudinal axis of the bore 128 of the large caliber gun. In another embodiment of the present disclosure, the optical sighting system of the large caliber gun is adjusted to intersect the first longitudinal axis of the bore 128 of the large caliber gun. The optical sighting system is adjusted to perform the bore sighting of the large caliber gun.

The imaging device 116 is removed from the muzzle-end adapter 100 after performing the bore sighting of the large caliber gun. Further, the first-hand lever 102 is counter rotated. The counter rotation of the first-hand lever permits counter rotation of the main operating shaft 114. The counter rotation of the main operating shaft 114 permits the disk 124 and the second-section 108 to slide back to its original position. Furthermore, the plurality of sets of centering fingers comes back to resting position and detach from the bore 128 of the large caliber gun. In addition, the muzzle-end adapter 100 is removed from the bore 128 of the large caliber gun.

The foregoing descriptions of pre-defined embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed:

1. A muzzle-end adapter for bore sighting of large caliber guns, the muzzle-end adapter comprising:

a main operating shaft extending along a first longitudinal axis;

a disk, wherein the disk is mechanically coupled with the main operating shaft, wherein rotation of the main operating shaft provides rectilinear motion to the disk;

a main body lying substantially along the first longitudinal axis, wherein the main body encapsulates the main operating shaft, wherein the main body comprises:

a first-section, a second-section, wherein the second-section comprises a plurality of sets of centering fingers, wherein the second-section encapsulates the disk; and a plurality of conical disks, wherein the plurality of conical disks comprises a first conical disk and a second conical disk, wherein the first conical disk is positioned at a second end of the second-section, wherein the second conical disk is positioned at a first end of the second-section, wherein rectilinear motion of the second-section over the plurality of conical disks radially expands one or more centering fingers of the plurality of sets of centering fingers.

2. The muzzle-end adapter as recited in claim 1, wherein the main operating shaft has a first shaft end and a second shaft end, wherein the first-section has a first end face and a second end face, wherein the first end face of the first-section is co-planar to the first shaft end of the main operating shaft.

3. The muzzle-end adapter as recited in claim 1, wherein a periphery of the disk is rigidly affixed with the second-section such that the second-section reciprocates with the disk.

4. The muzzle-end adapter as recited in claim 1, wherein the plurality of conical disks is coaxial with the main operating shaft.

5. The muzzle-end adapter as recited in claim 1, wherein the second-section is characterized by a cylindrical cross-section, wherein the second-section has a first end and a second end, wherein the cylindrical cross section of the second-section enables insertion of the second-section into bore of the large caliber gun, wherein the centering fingers of the plurality of sets of centering fingers expand uniformly to align symmetrically with the bore of the large caliber gun, wherein the symmetrical alignment of the muzzle-end adapter inside the bore of the large caliper gun enables the bore sighting of the large caliber guns.

6. The muzzle-end adapter as recited in claim 1, wherein the first conical disk is rigidly affixed with the first-section of the main body, wherein the second conical disk is affixed with the first conical disk with facilitation of a plurality of rigid bars.

7. The muzzle-end adapter as recited in claim 1, wherein the main operating shaft has a tapered intrusion designed to receive an imaging device having a corresponding conical attachment, wherein the tapered intrusion comprises a plurality of grooves, wherein the plurality of grooves enables a spring-loaded self-locking mechanism for the imaging device.

8. The muzzle-end adapter as recited in claim 1, wherein the plurality of sets of centering fingers comprises a first set of centering fingers and a second set of centering fingers.

9. The muzzle-end adapter as recited in claim 1, wherein the main operating shaft has a first threading, wherein the first conical disk has a second threading, wherein the main operating shaft is fastened with the facilitation of threads with the first conical disk.

10. A muzzle-end adapter for bore sighting of large caliber guns, the muzzle-end adapter comprising:

a main operating shaft extending along a first longitudinal axis, wherein the main operating shaft has a first shaft end and a second shaft end;

a disk, wherein the disk is mechanically coupled with the main operating shaft, wherein rotation of the main operating shaft provides rectilinear motion to the disk;

a main body lying substantially along the first longitudinal axis, wherein the main body encapsulates the main operating shaft, wherein the main body comprises:

a first-section, wherein the first-section has a first end face and a second end face, wherein the first end face of the first-section is co-planar to the first shaft end of the main operating shaft;

a second-section, wherein the second-section is characterized by a cylindrical cross-section, wherein the second-section has a first end and a second end, wherein the second-section comprises a plurality of sets of centering fingers, wherein the second-section encapsulates the disk, wherein periphery of the disk is rigidly affixed with the second-section such that the second-section reciprocates with the disk; and a plurality of conical disks, wherein the plurality of conical disks are coaxial with the main operating shaft, wherein the plurality of conical disks comprises a first conical disk and a second conical disk, wherein the first conical disk is positioned at a second end of the second-section, wherein the second conical disk is positioned at a first end of the second-section, wherein rectilinear motion of the second-section over the plurality of conical disks radially expands one or more centering fingers of the plurality of sets of centering fingers.

11. The muzzle-end adapter as recited in claim 10, further comprising a first-hand lever and a second-hand lever, wherein the first-hand level is rigidly affixed with the first shaft end of the main operating shaft, wherein the second-hand level is rigidly affixed with the first end face of the first-section.

12. The muzzle-end adapter as recited in claim 10, wherein an outer surface of the disk is rigidly affixed with a portion of an inner surface of the second-section.

13. The muzzle-end adapter as recited in claim 10, wherein the first conical disk is rigidly affixed with the first-section of the main body, wherein the second conical disk is affixed with the first conical disk with facilitation of a plurality of rigid bars.

14. The muzzle-end adapter as recited in claim 10, wherein the main operating shaft has a tapered intrusion on the first shaft end, wherein the tapered intrusion is designed to receive an imaging device having a corresponding conical attachment, wherein the tapered intrusion comprises a plurality of grooves and wherein the plurality of grooves enables a spring-loaded self-locking mechanism for the imaging device.

15. The muzzle-end adapter as recited in claim 10, wherein the cylindrical cross section of the second-section enables insertion of the second-section into bore of a large caliber gun, wherein the one or more centering fingers of the plurality of sets of centering fingers expand uniformly to align symmetrically with the bore of the large caliber gun, wherein the symmetrical alignment of the muzzle-end adapter inside the bore of the large caliper gun enables the bore sighting of the large caliber gun.

16. The muzzle-end adapter as recited in claim 10, wherein the plurality of sets of centering fingers comprises a first set of centering fingers and a second set of centering fingers, wherein the first set of centering fingers are uniformly distributed over the second-section adjacent to the first end of the second-section, wherein the second set of centering fingers are uniformly distributed over the second-section adjacent to the second end of the second-section.

17. The muzzle-end adapter as recited in claim 10, wherein the main operating shaft has a first threading, wherein the first conical disk has a second threading, wherein the main operating shaft is fastened with facilitation of threads with the first conical disk.

* * * * *